US005720624A

United States Patent [19]

Ikeda

[11] Patent Number: 5,720,624

[45] Date of Patent: Feb. 24, 1998

[54] SCREW-COUPLED TYPE CONNECTOR

[75] Inventor: Tomohiro Ikeda, Kosai, Japan

[73] Assignee: Yazaki Corporation, Tokyo, Japan

[21] Appl. No.: 812,082

[22] Filed: Mar. 6, 1997

[30] Foreign Application Priority Data

Mar. 8, 1996 [JP] Japan ..... 8-051761

[51] Int. Cl.[6] ..... H01R 13/627

[52] U.S. Cl. ..... 439/364

[58] Field of Search ..... 439/345, 359, 439/362, 364

[56] References Cited

U.S. PATENT DOCUMENTS 5,201,625 4/1993 Takenouchi et al. ..... 439/364 X
5,588,865 12/1996 Yamamoto ..... 439/364 OR

FOREIGN PATENT DOCUMENTS 5-31148 4/1993 Japan .

*Primary Examiner*—Neil Abrams
*Assistant Examiner*—Daniel Wittels
*Attorney, Agent, or Firm*—Armstrong, Westerman, Hattori, McLeland & Naughton

[57] ABSTRACT

A first connector has a first nut with a large-diameter threaded hole, and a throughhole wherein the first nut is fixed. A second connector has a second-nut with a small-diameter threaded hole. A small-diameter bolt having a diameter smaller than that of the threaded hole of the first nut is passed through the first nut and threaded into the second nut, with the small-diameter bolt held stationary in the longitudinal direction thereof, so that the second connector is pulled to the first connector and coupled thereto. To decouple the connectors, a large-diameter bolt is threaded through the first nut to push the second connector apart from the first connector. A reduction is made in the weight of the screw-coupled type connector and in costs.

9 Claims, 3 Drawing Sheets

SCREW-COUPLED TYPE CONNECTOR

BACKGROUND OF THE INVENTION

1. Field of the Invention

This invention relates to a connector of a screw-coupled type in which a bolt, after threaded into a nut to couple male and female connectors, is removed to reduce the weight of the connector.

2. Description of the Related Art

FIG. 6 shows a conventional screw-coupled type connector described in Japanese Utility Model Application Laid-Open Specification No. 5-31148.

This connector 41 is comprised of a male connector 43 with a bolt 42 rotatably mounted and extending therethrough at a center and a female connector 45 with a nut 44 for the bolt 42 fixed therein. The bolt 42 is longitudinally immovably set to the male connector housing 48 with means 46 such as a washer, E-ring or the like. The bolt 42 is rotated at its head 42*a* with a tool 47 such as an impact wrench or the like in a vehicle assembly process to couple the male and female connectors 43, 45 together. The use of this screw makes it possible for multipolar connectors to be coupled to each other.

The conventional screw-coupled type connector 41 as mentioned above, however, has drawbacks. In other words, to ensure the alignment of the bolt 42 and the nut 44 at the initial stage of coupling, plays of the bolt 42 needs to be prevented. To this end, a shaft 42*b* of the bolt 42 is set long, causing the bolt 42 to gain weight and the bolt supporting portion 49 of the male connector housing 48 to be thickened, resulting in the male connector 43 weighing heavy.

Further, the coupling of the bolt 42 and the nut 44 is effected at vehicle assembly lines and almost not at all effected thereafter during the use of the vehicle by a user. Although in rare cases where a vehicle is repaired, the bolt 42 may be rotated to decouple and re-couple the connectors 43 and 45, the bolt 42 is an unnecessary part for the user. Nevertheless, this bolt 42 is a special, high-cost one. Further, the bolt 42 requires its mounting means 48 such as a washer, E-ring or the like, resulting in high mounting costs.

SUMMARY OF THE INVENTION

This invention has been accomplished to overcome the above drawbacks and an object of this invention is to provide a screw-coupled type connector which solves the increase in weight by the use of a bolt and the increase in costs.

In order to attain the object, according to this invention, there is provided a connector of a screw-coupled type comprising: a first connector having a first nut with a large-diameter threaded hole, a throughhole wherein the first nut is provided such that the threaded hole of the first nut aligns with the throughhole, and abutment means provided on a proximal side of the first nut; a small-diameter bolt of a diameter smaller than that of the threaded hole of the first nut, having stopper means for abutment against the abutment means of the first connector; a second connector having a second nut with a small-diameter threaded hole, arranged on a side of the first connector remote from the small-diameter bolt, whereby the first and second connectors are coupleable to each other when the small-diameter bolt is passed through the first nut and threaded into the second nut, with the stopper means of the small-diameter bolt supported on the abutment means of the first connector, and whereby the first and second connectors are decoupleable when a large-diameter bolt is threaded through the first nut to push the second connector apart from the first connector.

In operation, the small-diameter bolt is passed through the first nut to be threaded into the second nut. By rotating the small-diameter bolt, the second connector is pulled together with the second nut to the first connector and coupled to the same. To decouple the first and second connectors, the large-diameter bolt is rotated and threaded through the first nut so that the front end thereof pushes the second connector apart to decouple the connectors from each other.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described with reference to the attached drawings.

Figure 1:
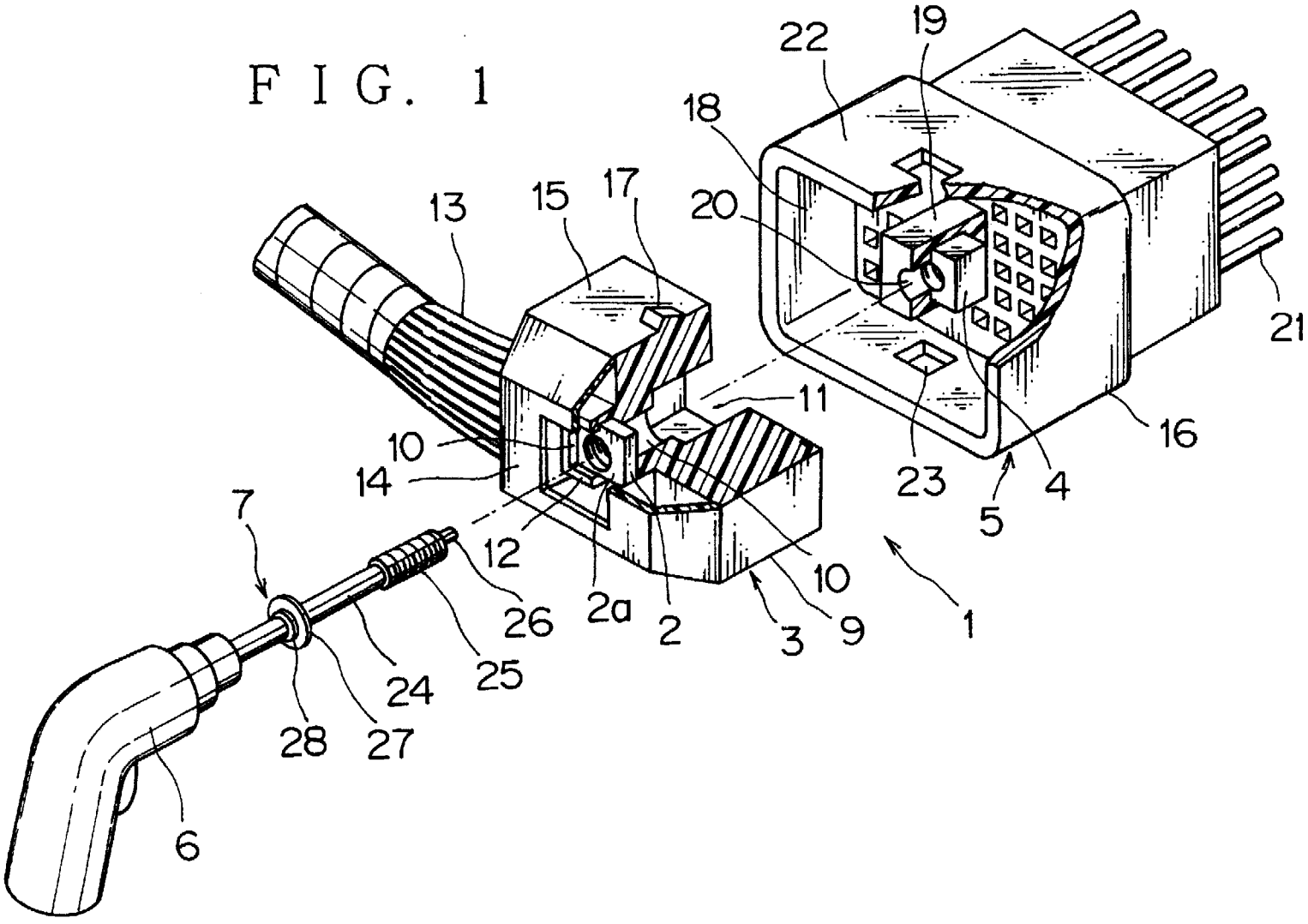
FIG. 1 is an exploded partially cutaway view of a screw-coupled type connector according to one embodiment of this invention.
Figure 2:
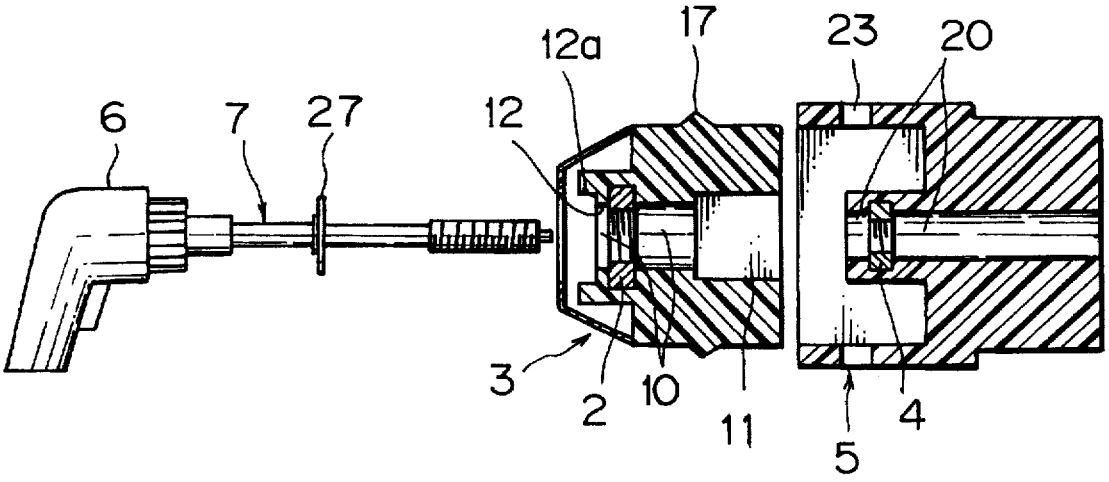
FIG. 2 is a longitudinal sectional view of the screw-coupled type connector of FIG. 1.
Figure 4:
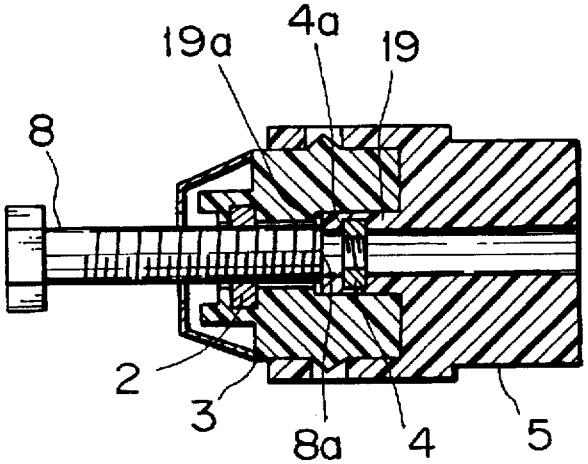
FIG. 4 is a longitudinal sectional view of the connectors of FIG. 3 about to be decoupled by using a large-diameter bolt.

FIGS. 1 and 2 show a connector 1 of a screw-coupled type according to one embodiment of this invention. The connector 1 is comprised of a male connector 3 with a first nut 2 incorporated therein, which nut has a large-diameter threaded hole (hereinafter abbreviated as "large nut"), and a female connector 5 with a second nut 4 incorporated therein which has a small-diameter threaded hole (hereinafter abbreviated as "small nut"). The small nut 4 is threadable over a small-diameter bolt (male screw device) 7 set at the front end of a mounting driver (impact driver) 8. The large nut 2 is threadable over a large-diameter bolt 8 of a diameter larger than that of the small-diameter bolt 4 (FIG. 4). The "large nut", as indicated in FIG. 1, means a nut whose threaded hole is large in diameter and does not necessarily require the outside dimensions to be larger than the small nut.

The large nut 2 is incorporated in a male connector housing 9 of synthetic resin at a central rear (distal) portion thereof by force fit, integral molding or the like. A throughhole 10 extends on front and rear sides of the large nut 2 and communicates, on the front, connector-coupling side, to an empty rectangular chamber 11 formed in the connector housing 9, the chamber having a diameter larger than that of the throughhole 10. On the rear side of the large nut 2, there is provided an abutment means 12 having an abutment surface 12*a*. The inner diameter of the large nut 2 is larger than the outer diameter of the small-diameter bolt 7 and allows the small-diameter bolt 7 to pass therethrough. In this connection, it is also possible to omit the above-mentioned abutment means 12 and have the rear end surface 2a of the large nut 2 serve as the abutment surface.

A plurality of not-shown female terminals are accommodated inside the male connector housing 9, which are connected to respective wires 13 extending from a rear, lateral side of the connector housing 9 in the form of a wiring harness. A cover 14 is provided on the rear of the connector housing 9. On opposite side walls 15 of the male connector housing 9, there are formed locking projections 17 for a mating female connector housing 16.

The female connector housing 16 has a coupling chamber 18 where the male connector housing 9 is fitted to be coupled. A boss portion 19 is provided protruding at a center in the coupling chamber 18, and the small nut 4 is incorporated inside the boss portion 19. A throughhole 20 extends on the front and rear sides of the small nut 4. A plurality of not-shown male terminals are provided protruding into the coupling chamber 18, the male terminals being connected to respective wires 21 which extend rearwardly in the form of a wiring harness. On opposite outer walls 22 of the coupling chamber 18, there are provided locking holes 23 which correspond to the locking projections 17 on the male connector housing 9. The boss portion 19 is insertable into the empty chamber 11 of the male connector 3, and the small-diameter bolt 7 of the mounting driver 6 is threadable into the small nut 4.

The small-diameter bolt 7 is comprised of a shaft 24, a male screw 25 at a front portion of the shaft 24, and a guiding pilot 28 at the front end of the male screw 25. A flange-like stopper 27 is rigidly fixed at an intermediate length of the shaft 24 by means of an E-ring 28 or the like for abutment against the abutment means 12 of the male connector housing 9. The small-diameter bolt 7 is rotated by trigger-operating the driver 6. If the abutment means 12 is not provided in the connector housing 9, the flange-like stopper 27 will be brought into abuttent against the end surface 2a of the large nut 2.

By way of example, a nut of the size of M10 (screw inner diameter $\phi$8.376) or M8 (screw inner diameter $\phi$6.647) is employed for the large nut 2, and a nut of the size of M6 for the small nut 4. A bolt of M6 (outer diameter $\phi$6) is employed for the small-diameter bolt 7, and a bolt of M10 or M8 for a later-described large-diameter bolt 8. (The sizes are based on the Japanese Industrial Standard, B 0205.)

Figure 3:
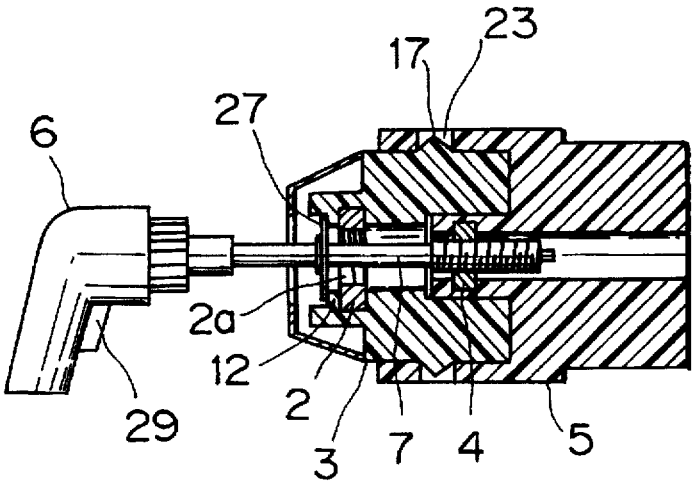
FIG. 3 is a longitudinal sectional view of male and female connectors of FIG. 2, coupled by using a tool.

FIG. 3 shows the male and female connectors 3 and 5 coupled to each other by using the mounting driver 6. To effect the coupling, the connectors 3 and 5 are initially coupled by hand from the state as shown in FIG. 2, and then the small-diameter bolt 7 of the mounting driver 6 is passed through the hole 2a of the large nut 2 of the male connector 3 into contact with the small nut 4 of the female connector 5, while at the same time bringing the stopper 27 into contact with the abutment surface 12a of the abutment means 12 of the male connector 3. A trigger 29 is then pulled to clockwise rotate and thread the small-diameter bolt 7 into the small nut 4, which causes the small nut 4 and thus the female connector 5 to be pulled towards the male connector 3, and the connectors 3 and 5 to be coupled.

Concurrently therewith, the locking projections 17 of the male connector 3 engage in the locking holes 23 of the female connector 5 to lock the connectors 3 and 5 to each other. After completion of the connector coupling, the small-diameter bolt 7 is rotated reverse (counterclockwise) and removed out of the male connector 3. A connectors-coupled state without the bolt 7 is thus obtained. The coupling of the connectors 3 and 5 with the mounting driver 6 is mainly effected at automobile assembling lines.

FIG. 4 shows the state where the connectors 3 and 5 are about to be decoupled in an auto repair shop or the like. To decouple, a large-diameter bolt 8 is threaded through the large nut 2 on the male connector 3 side to bring its front end 8a into contact with the front end 19a of the boss portion 19 of the female connector 5 (or the front end surface 4a of the small nut 4). As the large-diameter bolt 8 is further threaded, the female connector 5 is pushed out to be decoupled.

Figure 5:
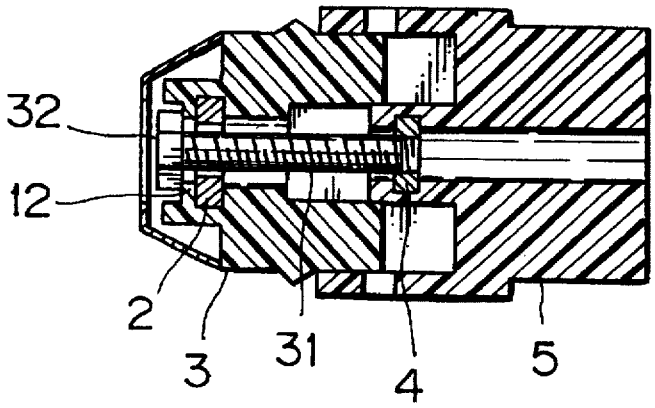
FIG. 5 is a longitudinal sectional view of the connectors of FIG. 3 about to be re-coupled with a small-diameter bolt after decoupled in FIG. 4.
Figure 6:
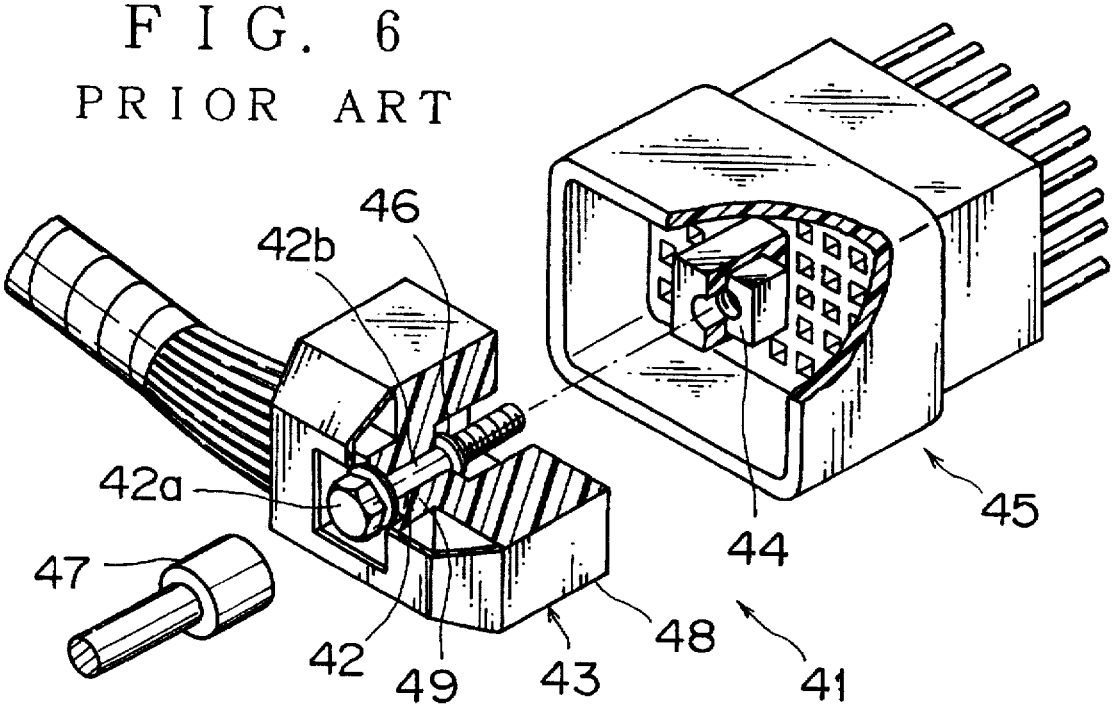
FIG. 6 PRIOR ART
FIG. 6 is an exploded partially cutaway view of a conventional screw-coupled type connector.

FIG. 5 shows the state where the connectors 3 and 5 are about to be re-coupled. To re-couple, a commercially-available (standard) small-diameter bolt 31 is passed through the large nut 2 and threaded into the small nut 4. The small-diameter bolt 31 is further threaded, with its head 32 supported on the abutment means 12 of the male connector 3 so that the female connector 5 is pulled and coupled to the male connector 3. After completion of the coupling, the small-diameter bolt 31 is rotated reverse to be pulled out. A connectors-coupled state without the small-diameter bolt 31 is thus obtained.

The large nut 2 is lighter in weight than the small-diameter bolt 7, 31, and the non-presence of the bolt 7, 31 leads to a reduction in the weight of the coupled connectors. The commercially-available small-diameter bolt 31 is easily obtainable at a low price.

It is also possible that the large and small nuts 2 and 4 are formed of synthetic resin integrally with the connector housings 9 and 16, respectively.

As described hereinabove, since according to this invention the bolt is removed after the coupling of connectors is completed, a reduction is made in the weight of connectors. Since a special bolt is recovered, a reduction is made in the costs of parts and mounting. Further, since the bolt-supporting part of a connector does not require to be set long as in the conventional connector, a downsized connector can be obtained.

Having now fully described the invention, it will be apparent to one of ordinary skill in the art that many changes and modifications can be made thereto without departing from the spirit and scope of the invention as set forth herein.

What is claimed is:

1. A connector of a screw-coupled type comprising:

a first connector having a first nut with a large-diameter threaded hole, a throughhole wherein said first nut is provided such that the threaded hole of said first nut aligns with said throughhole, and abutment means provided on a proximal side of said first nut;

a small-diameter bolt of a diameter smaller than that of the threaded hole of said first nut, having stopper means for abutment against said abutment means of said first connector;

a second connector having a second nut with a small-diameter threaded hole, arranged on a side of said first connector remote from said small-diameter bolt, whereby said first and second connectors are coupleable to each other when said small-diameter bolt is passed through said first nut and threaded into said second nut, with said stopper means of said small-diameter bolt supported on said abutment means of said first connector, and whereby said first and second connectors are decoupleable when a large-diameter bolt is threaded through said first nut to push said second connector apart from said first connector.

2. The connector according to claim 1, further comprising locking means that keeps, when the coupling is completed, said first and second connectors coupled to each other.

3. The connector according to claim 2, wherein said locking means comprises a projection and a corresponding hole, one provided on said first connector and the other on said second connector.

4. The connector according to claim 1, wherein said first connector is a male connector and said second connector is a female connector.

5. The connector according to claim 1, wherein said abutment means comprises an abutment surface formed separate from said first nut.

6. The connector according to claim 1, wherein said abutment means comprises an end surface of said first nut.

7. The connector according to claim 1, wherein said stopper means comprises a flange-like stopper fixed around said small-diameter bolt at a distance from a front end thereof.

8. The connector according to claim 1, wherein said stopper means comprises a head of said small-diameter bolt.

9. The connector according to claim 1, further comprising an empty chamber formed at a distal end portion of said throughhole for receipt therein of said second nut.

* * * * *